US009232832B2

(12) United States Patent
Kelly

(10) Patent No.: US 9,232,832 B2
(45) Date of Patent: Jan. 12, 2016

(54) DECORATIVE ATTACHING APPARATUS FOR SHIRT COLLAR AND SLEEVE CUFFS

(71) Applicant: Byron Alexander Kelly, Silver Spring, MD (US)

(72) Inventor: Byron Alexander Kelly, Silver Spring, MD (US)

( * ) Notice: Subject to any disclaimer, the term of this patent is extended or adjusted under 35 U.S.C. 154(b) by 513 days.

(21) Appl. No.: 13/784,339

(22) Filed: Mar. 4, 2013

(65) Prior Publication Data

US 2013/0232730 A1 Sep. 12, 2013

Related U.S. Application Data

(60) Provisional application No. 61/607,685, filed on Mar. 7, 2012, provisional application No. 61/615,537, filed on Mar. 26, 2012.

(51) Int. Cl.

| | |
|---|---|
| ***A41B 3/00*** | (2006.01) |
| ***A44B 6/00*** | (2006.01) |
| ***A44B 5/00*** | (2006.01) |
| ***A44B 3/00*** | (2006.01) |

(52) U.S. Cl.

CPC ... *A44B 6/00* (2013.01); *A44B 3/00* (2013.01); *A44B 5/00* (2013.01); *Y10T 24/1972* (2015.01); *Y10T 24/3649* (2015.01)

(58) Field of Classification Search

CPC ..... A44B 3/00; A44B 6/00; A44B 5/00; A41B 3/06; Y10T 24/3659; Y10T 24/1972

USPC ..... 2/137, 132; 24/301, 358, 507, 102 R

See application file for complete search history.

(56) References Cited

U.S. PATENT DOCUMENTS

| | | | | | |
|---|---|---|---|---|---|
| 364,143 | A * | 5/1887 | Stone | A44B 5/02 | 24/103 |
| 526,746 | A * | 10/1894 | Ruffner | A44B 9/10 | 24/356 |
| 1,333,398 | A * | 3/1920 | Elizondo | A41B 3/12 | 2/137 |
| 1,377,499 | A * | 5/1921 | Mullaly | A41B 3/12 | 2/137 |
| 1,445,798 | A * | 2/1923 | Phillips | A41F 19/005 | 24/301 |
| 1,470,471 | A * | 10/1923 | Peters | A41F 19/005 | 2/323 |
| 1,510,258 | A * | 9/1924 | Crnoev | A41B 3/08 | 24/115 H |
| 1,797,790 | A * | 3/1931 | Patton | A41B 3/06 | 2/132 |
| 2,146,227 | A * | 2/1939 | Pyros | A41B 3/12 | 2/132 |
| 2,422,992 | A * | 6/1947 | Taborski | A41D 25/02 | 2/153 |
| 2,502,199 | A * | 3/1950 | Berger | A41B 3/08 | 24/265 B |
| 2,651,782 | A * | 9/1953 | Oulouhojian | A41B 3/06 | 2/132 |
| 2,867,815 | A * | 1/1959 | Wittenberg | A41B 3/06 | 2/132 |
| 2,992,434 | A * | 7/1961 | Weeks | A41B 3/06 | 2/132 |
| 3,075,202 | A * | 1/1963 | Rubio | A41B 3/06 | 2/132 |
| 3,405,407 | A * | 10/1968 | Ruane | A41B 3/04 | 2/132 |
| 4,118,803 | A * | 10/1978 | Blau | A41B 3/08 | 2/132 |
| 8,973,165 | B1 * | 3/2015 | Zaki | A41B 3/06 | 2/132 |
| 2014/0082890 | A1 * | 3/2014 | Johnson | A44B 5/02 | 24/102 R |

* cited by examiner

*Primary Examiner* — Richale Quinn

(57) ABSTRACT

A decorative attaching apparatus for shirt collar and sleeve cuffs includes an ornamental head, an attachment bar, and a locking encasement. The ornamental head is connected to the attachment bar, and the attachment bar engages with the locking encasement. The ornamental head is the only component which is visible to outside and the attachment bar and the locking encasement is hidden within the shirt collar or sleeve cuffs.

15 Claims, 23 Drawing Sheets

DECORATIVE ATTACHING APPARATUS FOR SHIRT COLLAR AND SLEEVE CUFFS

The current application claims a priority to the U.S. Provisional Patent application Ser. No. 61/607,685 filed on Mar. 7, 2012 and U.S. Provisional Patent application Ser. No. 61/615,537 on filed Mar. 26, 2012.

FIELD OF THE INVENTION

The present invention relates generally to an apparatus for a collar bar and cufflinks. More specifically, the present invention is an apparatus that is inserted through the collar of a shirt to keep the collar in place or inserted through the sleeve cuffs of the shirt to keep the sleeve cuffs in place.

BACKGROUND OF THE INVENTION

Many individuals wear shirts with collars and sleeve cuffs. These kinds of shirts are particularly appropriate for formal situations, in which an individual's appearance may be very important to make a positive impression on others. Unfortunately, there are no currently existing fashionable elements to be applied to the shirt collar to enhance the aesthetic appearance of the shirt collar when individuals are not wearing a tie. In addition, the individuals often have trouble keeping the shirt collar in its proper place on the shirt, resulting in shirt collars that are rumpled, creased, flimsy, or "popped."

It is therefore an object of the present invention to provide an apparatus that keeps the shirt collar and the sleeve cuffs in place while providing the desired fold and positioning of the shirt collar and the sleeve cuffs. It is a further object of the present invention to provide an ornamental stud to the shirt collar and the sleeve cuffs, increasing the aesthetic appeal of the shirt. The present invention provides a decorative pin and a locking body that can be locked in place easily and then easily removed from the shirt collar and the sleeve cuffs.

DETAIL DESCRIPTIONS OF THE INVENTION

All illustrations of the drawings are for the purpose of describing selected versions of the present invention and are not intended to limit the scope of the present invention.

Figure 1:
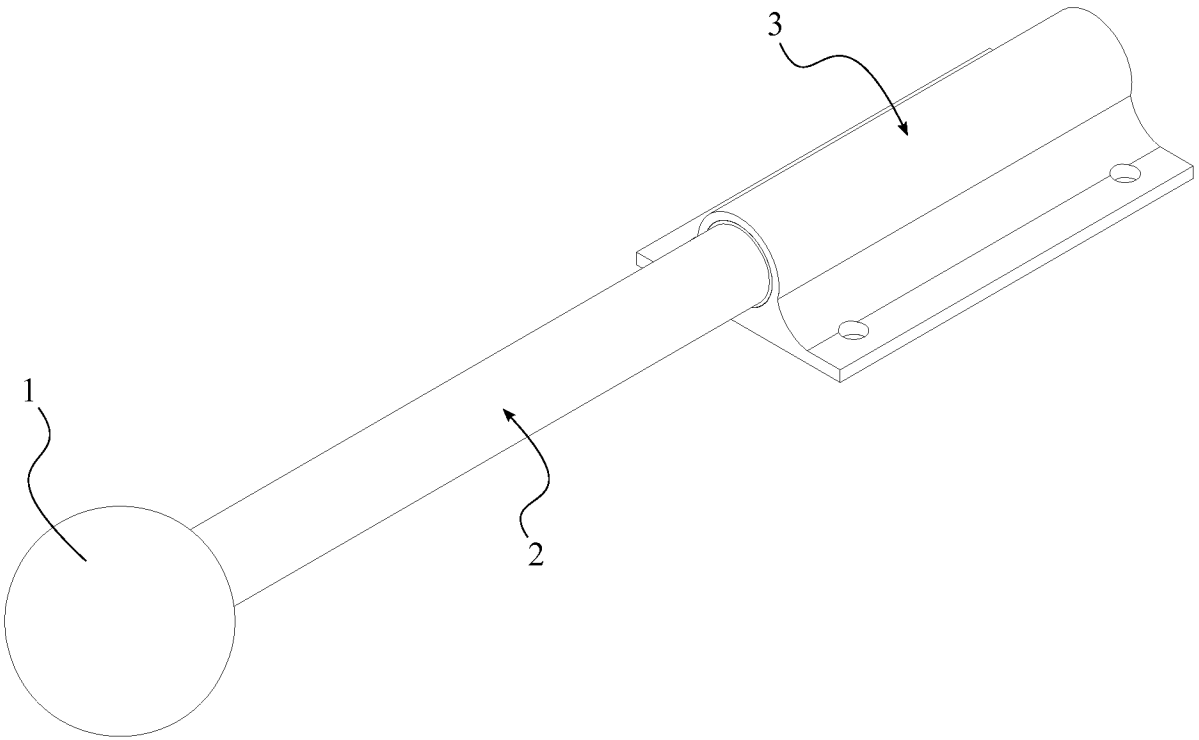
FIG. 1 is a perspective view of the present invention.

In reference to FIG. 1, the present invention is a decorative attaching apparatus for the shirt collar 6 and the sleeve cuffs, which comprises an ornamental head 1, an attachment bar 2, a locking encasement 3, and a plurality of loops 5. The ornamental head 1 is connected with the attachment bar 2, and a perimeter of the ornamental head 1 is bigger than a perimeter of the attachment bar 2. The shapes of the ornamental head 1 of the present invention include, but not limited, many different geometric shapes, many different organic shapes, or many different symbolic shapes, although any other desired shapes can be used. Since the ornamental head 1 is the only component that is visible, and the rest of the components of the present invention are hidden away, the ornamental head 1 provides the decorative aspect within the present invention.

The ornamental head 1 can be made from, but not limited to, plastic, glass, metal or any other lightweight and high strength materials.

Figure 3:
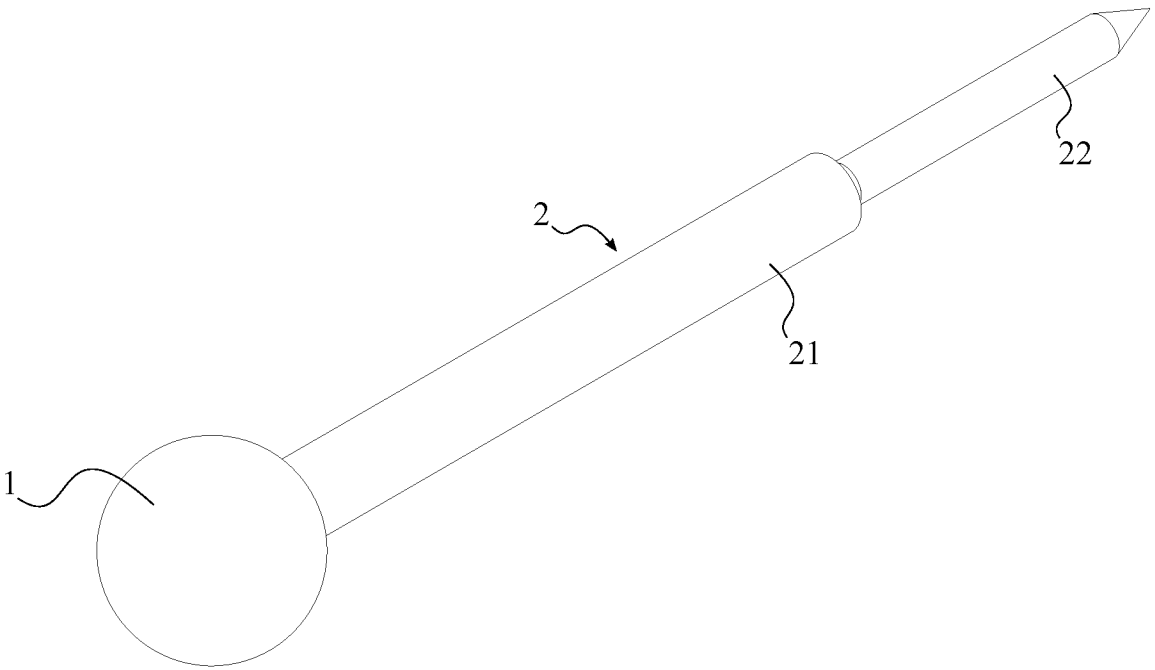
FIG. 3 is a perspective view of an ornamental head and an attachment bar of the present invention.
Figure 4:
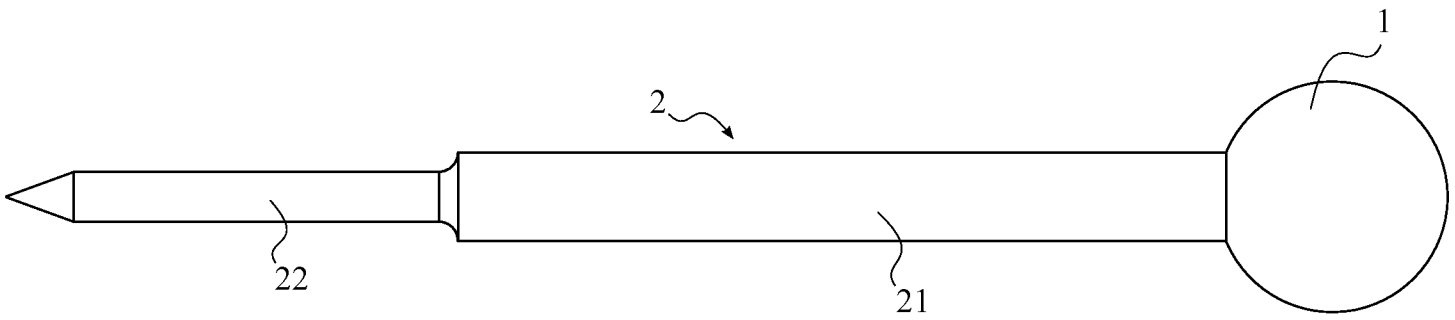
FIG. 4 is a side view of the ornamental head and the attachment bar of the present invention.

In reference to FIG. 3 and FIG. 4, the attachment bar 2 comprises a central shaft 21 and a tail portion 22, where the central shaft 21 is positioned in between the ornamental head 1 and the tail portion 22. The ornamental head 1 is concentrically connected with the central shaft 21 at a front end of the central shaft 21. The tail portion 22 is concentrically positioned with the central shaft 21 at a back end of the central shaft 21, where the tail portion 22 is positioned opposite from the ornamental head 1 along the central shaft 21. A perimeter of the central shaft 21 is always larger than a perimeter of the tail portion 22. The tail portion 22 comprises a tapered extremity, where the tapered extremity is oppositely positioned with the ornamental head 1 along the central shaft 21 and the tail portion 22. The central shaft 21 and the tail portion 22 of the preferred embodiment of the present invention comprise a cylindrical shape, although any other desired shapes can be used. Since the central shaft 21 and the tail portion 22 of the preferred embodiment are cylindrical, a diameter of the central shaft 21 is larger than a diameter of the tail portion 22. The attachment bar 2 can be made from, but not limited to, plastic, metal or any other lightweight and high strength materials. The attachment bar 2 functions as the bridge between the ornamental head 1 and the locking encasement 3 while keeping the shirt collar 6 and the sleeve cuffs in their proper place on the shirt. The attachment bar 2 is also able to prevent the shirt collar 6 and the sleeve cuffs from becoming rumple, crease, flimsy, and pooped.

Figure 2:
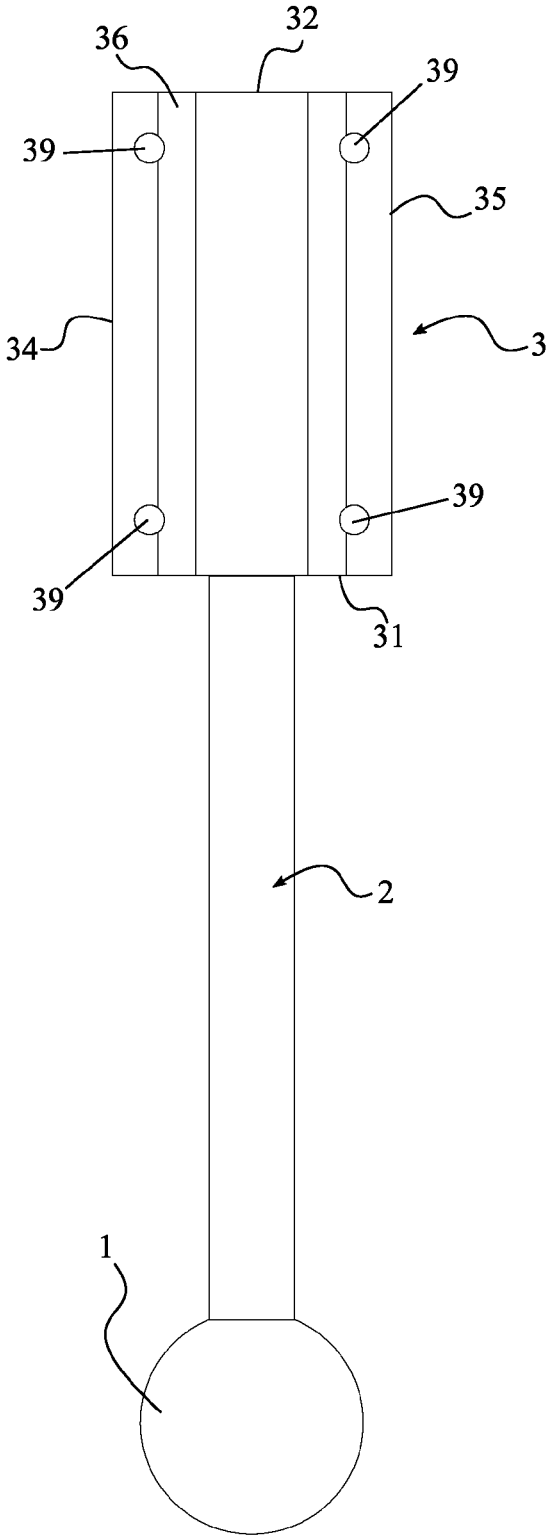
FIG. 2 is a top view of the present invention.
Figure 5:
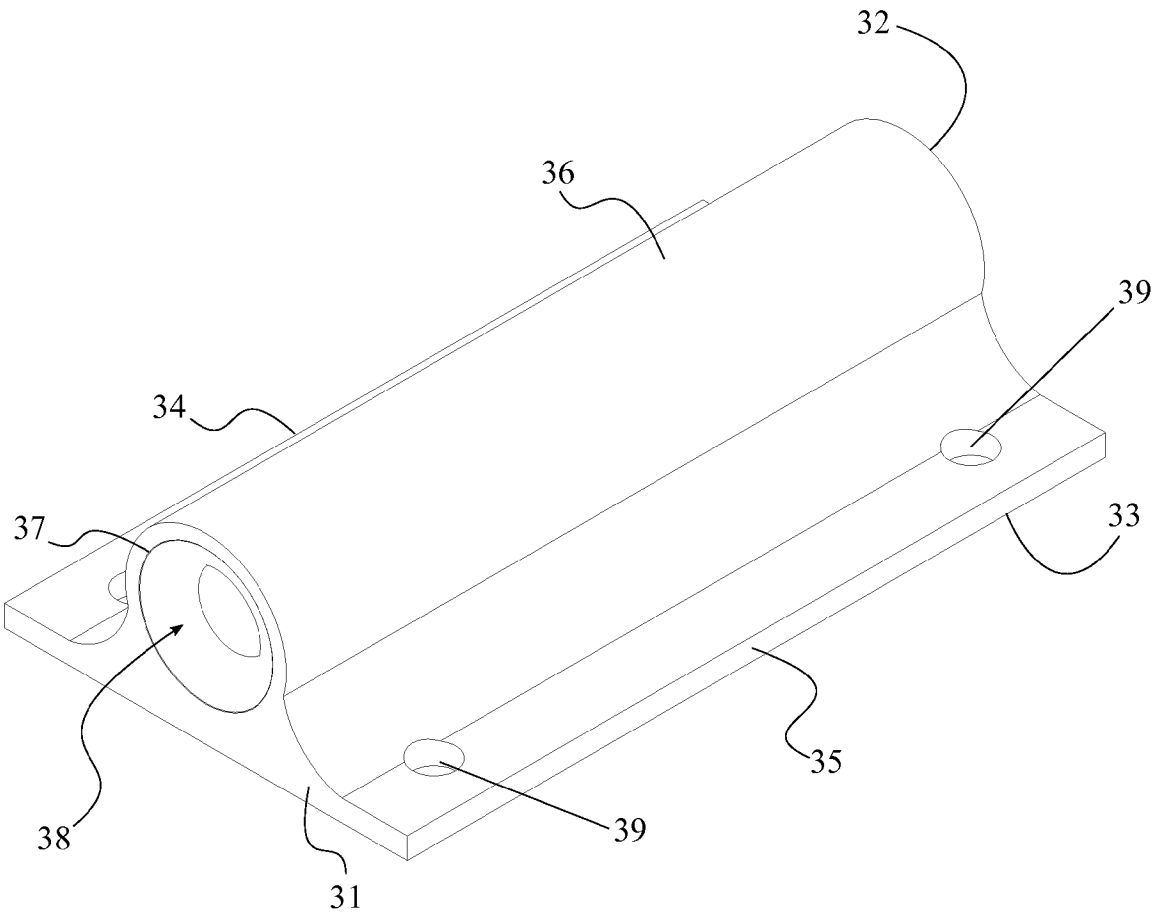
FIG. 5 is a perspective view of a locking encasement of the present invention.
Figure 7:
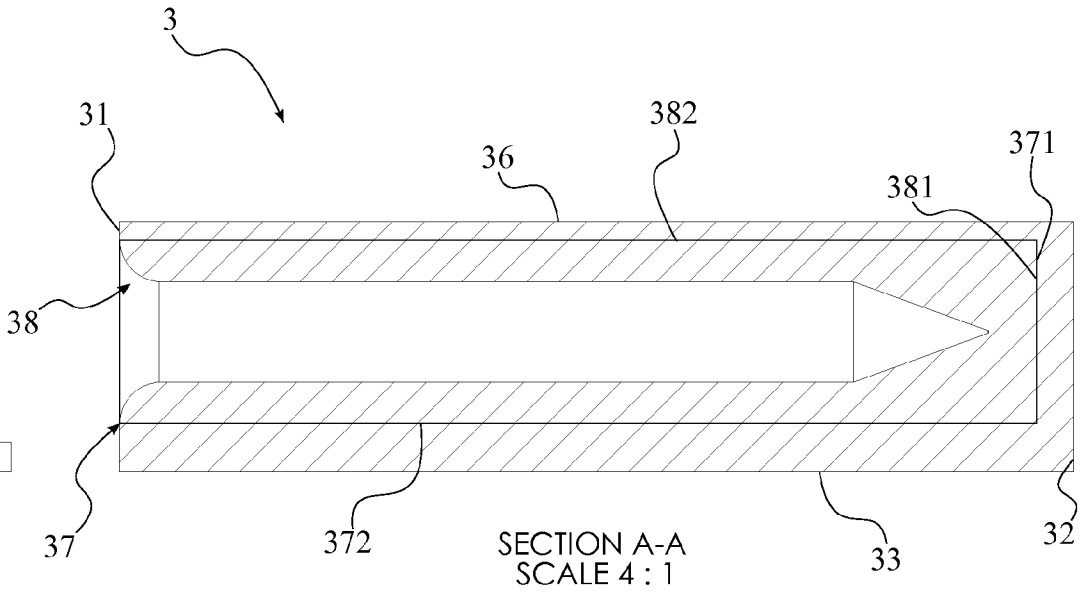
FIG. 7 is a cross section view of the locking encasement of the present invention taken along line A-A of FIG. 6.
Figure 6:
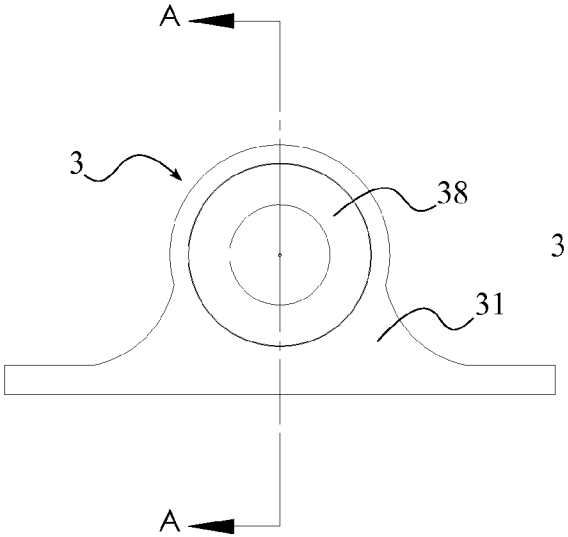
FIG. 6 is a front view of the locking encasement of the present invention, showing the plane upon which a cross sectional view is taken shown in FIG. 7.
Figure 8:
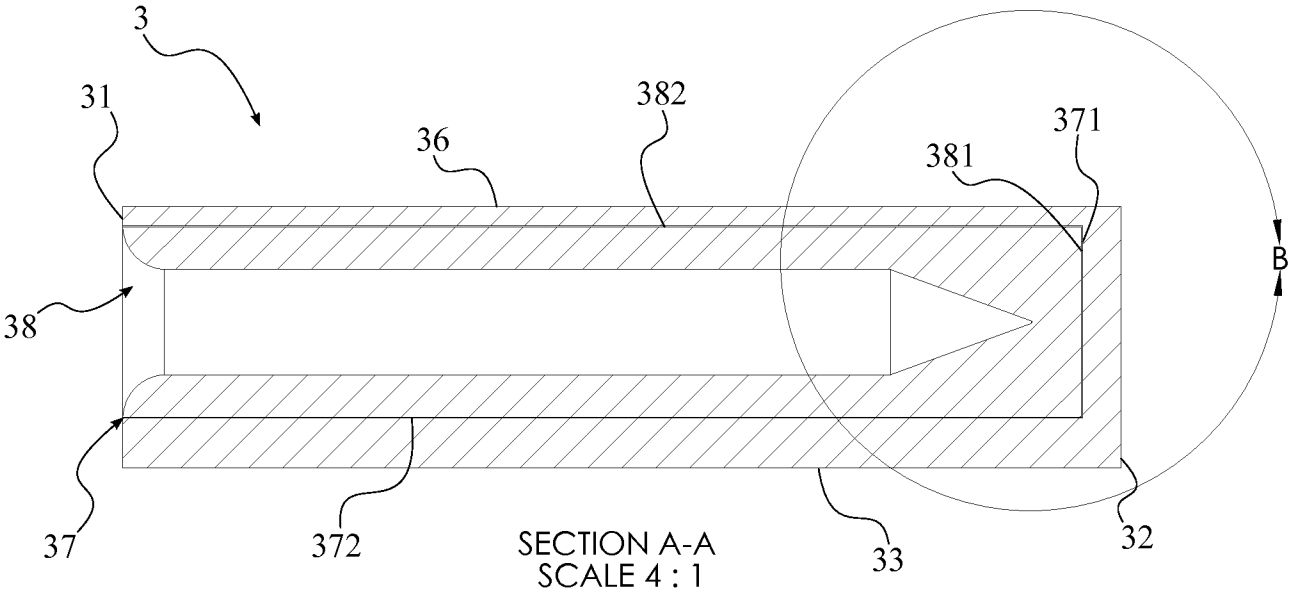
FIG. 8 is a cross section view of the locking encasement of the present invention taken along line A-A of FIG. 6, wherein the circle-B illustrates a detail view in FIG. 9.
Figure 9:
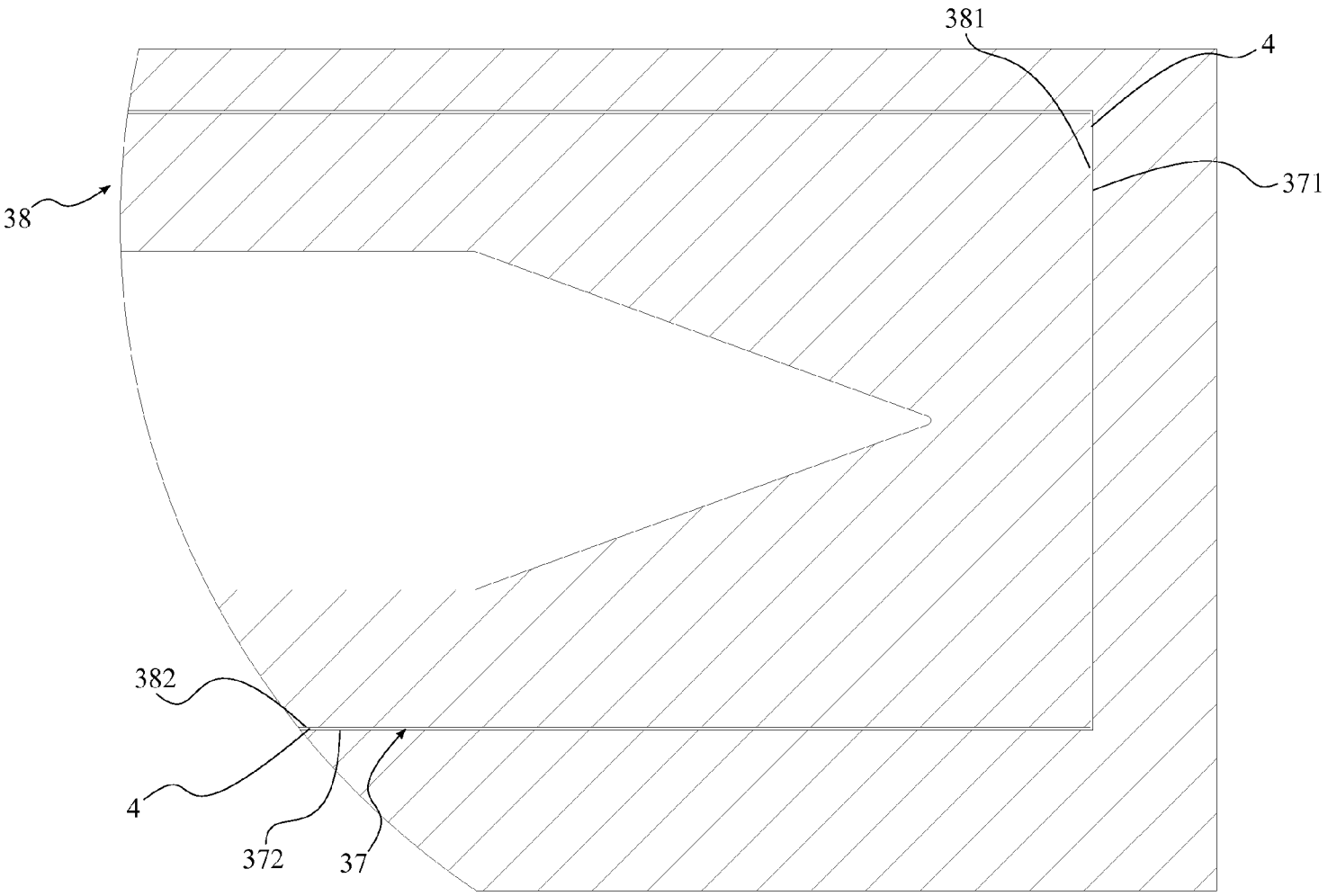
FIG. 9 is a detail view of the locking encasement of the present invention taken within the circle-B.

In reference to FIG. 2 and FIG. 5, the locking encasement 3 comprises a front surface 31, a rear surface 32, a bottom surface 33, a first side edge 34, a second side edge 35, a geometric top surface 36, an encasement cavity 37, an elastic locking casing 38, and a plurality of attachments 39. The front surface 31 and the rear surface 32 are oppositely positioned from each other, and the bottom surface 33 is perpendicularly positioned with the front surface 31 and the rear surface 32. The first side edge 34 is perpendicularly positioned with the front surface 31, the rear surface 32, and the bottom surface 33. The second side edge 35 is oppositely positioned from the first side edge 34, where the second side edge 35 is perpendicularly positioned with the front surface 31, the rear surface 32, and the bottom surface 33. The geometric top surface 36 is perimetrically positioned with the front surface 31, the rear surface 32, the first side edge 34, and the second side edge 35. The geometric top surface 36, the front surface 31, the rear surface 32, the first side edge 34, the second side edge 35, and the bottom surface 33 determine the shape of the locking encasement 3. The shape of the locking encasement 3 can be any geometric shapes as long as the locking encasement 3 can be positioned with the shirt collar 6. In the preferred embodiment, the front surface 31, the rear surface 32, the first side edge 34, and the second side edge 35 have a flat exterior, and the geometric top surface 36 has an upside down U-shaped exterior. The encasement cavity 37 traversed through the front surface 31 and is positioned within the bottom surface 33, the rear surface 32, the first side edge 34, the second side edge 35, and the geometric top surface 36. In reference to FIG. 6, FIG. 7, FIG. 8, and FIG. 9, in the preferred embodiment, the encasement cavity 37 has a circular shape and comprises an inner base 371 and an inner lateral wall 372. The elastic locking casing 38, which functions as a locking mechanism within the present invention, is concentrically positioned within the encasement cavity 37. In the preferred embodiment, the elastic locking casing 38 has a circular shape and comprises an outer base 381 and an outer lateral wall 382. The elastic locking casing 38 is permanently connected to the encasement cavity 37 through an adhesive material 4, where the outer base 381 is adjacently connected with the inner base 371, and the outer lateral wall 382 is adjacently connected with the inner lateral wall 372. The locking encasement 3 can be made from, but not limited to, plastic, metal, or combination of any. The elastic locking casing 38 is made from any type of elastic and fast recovery materials, such as rubber or memory foam, which can deform under a load or a weight but can recover when the load or the weight is removed. The plurality of attachments 39, which provides an attachment method for the locking encasement 3 so that the locking encasement 3 can be connected with the shirt collar 6, is adjacently positioned with the first side edge 34 and the second side edge 35. The plurality of attachments 39 can be, but not limited to, hooks and loops attachments, adhesive strip attachments, snap button attachments, and attachment holes. The plurality of attachment of the preferred embodiment comprises a plurality of attachment holes that connects the locking encasement 3 to a bottom collar section 63 of the shirt collar 6, which is connected with the neck opening of the shirt, by stitching.

Figures 10, 11:
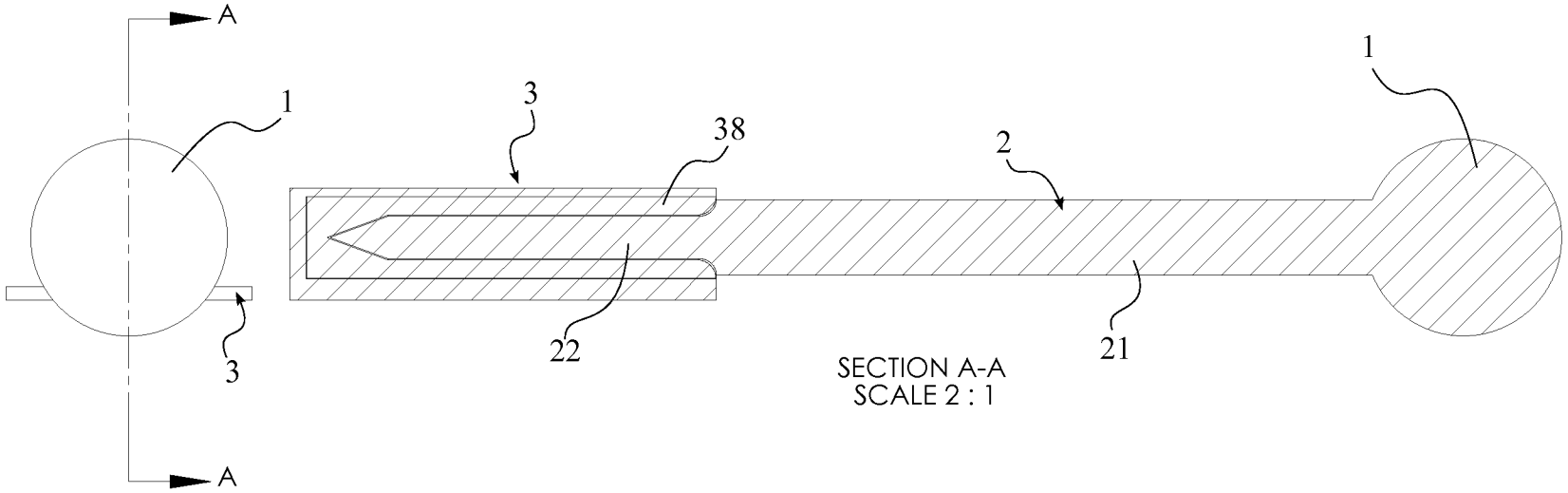
FIG. 10 is a front view of the present invention, showing the plane upon which a cross sectional view is taken shown in FIG. 11.
FIG. 11 is a cross section view of the present invention taken along line A-A of FIG. 10.
Figure 24:
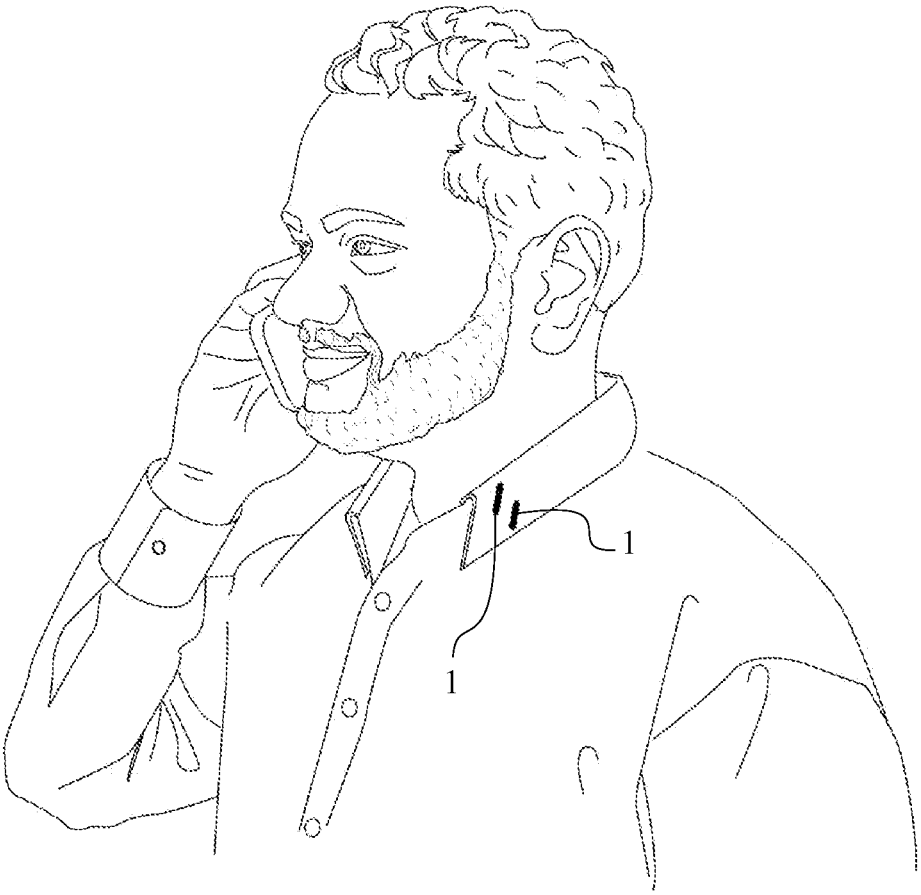
FIG. 24 is a first alternative front-side illustration of the present invention in use on a shirt collar of the wearer.
Figure 25:
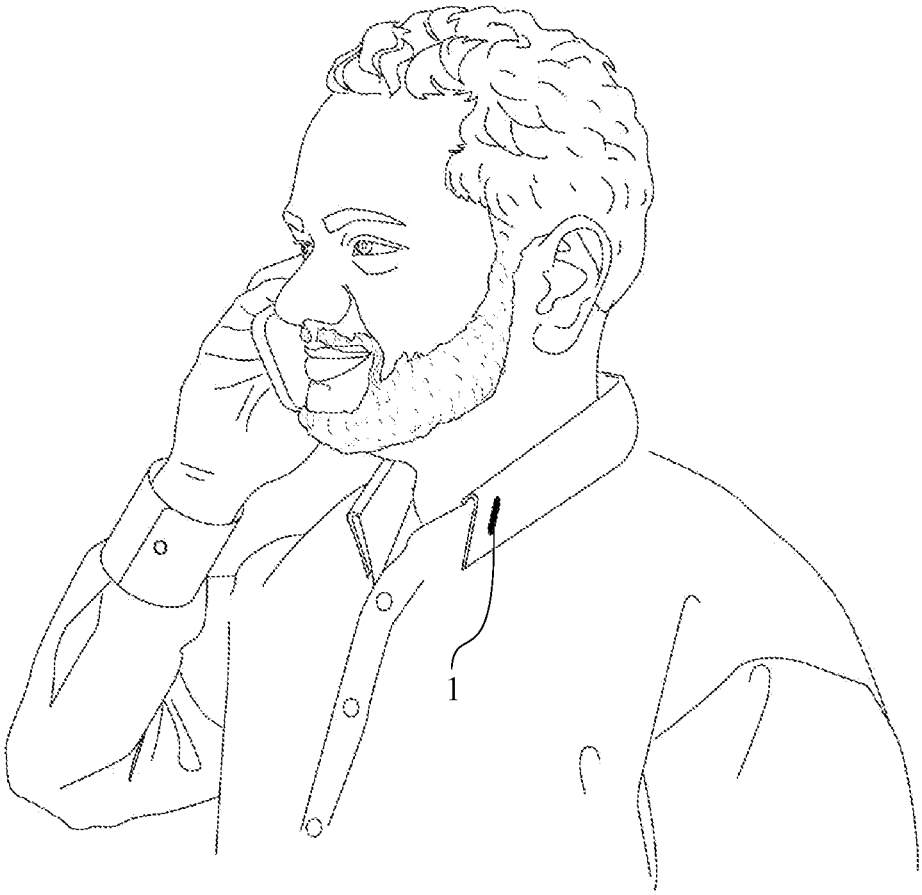
FIG. 25 is a second alternative front-side illustration of the present invention in use on the shirt collar of the wearer.
Figure 27:
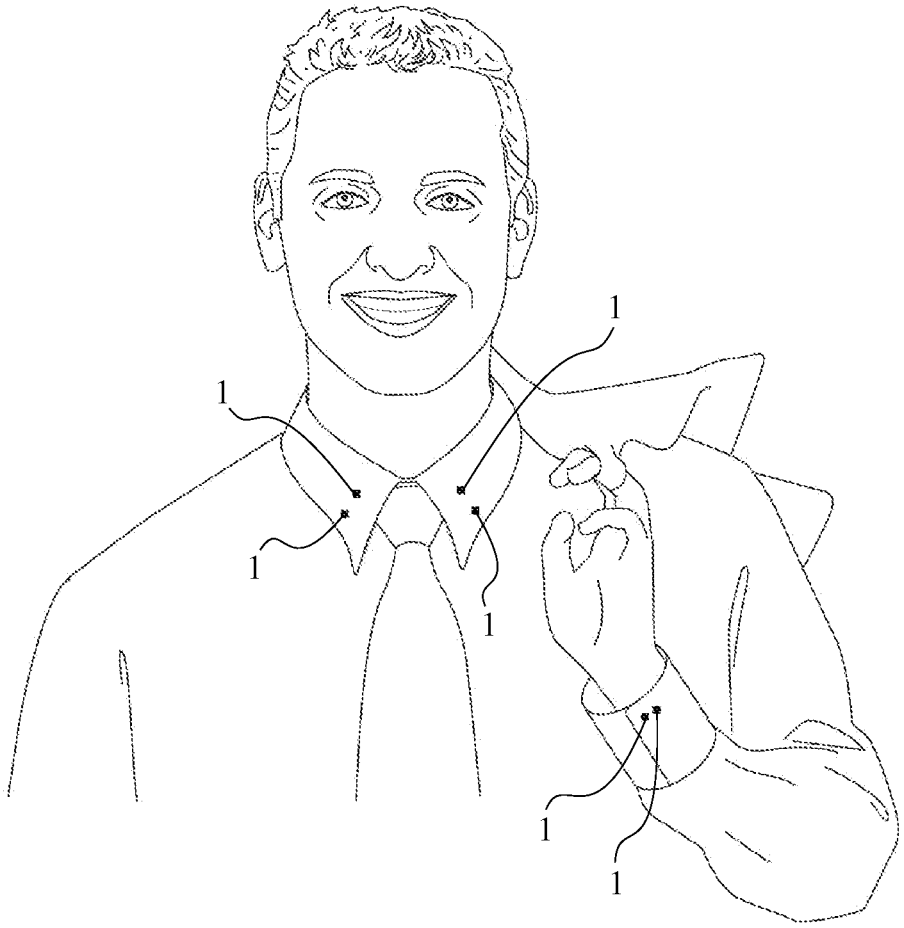
FIG. 27 is a fourth alternative front-side illustration of the present invention in use on the shirt collar and the sleeve cuff of the wearer.
Figure 28:
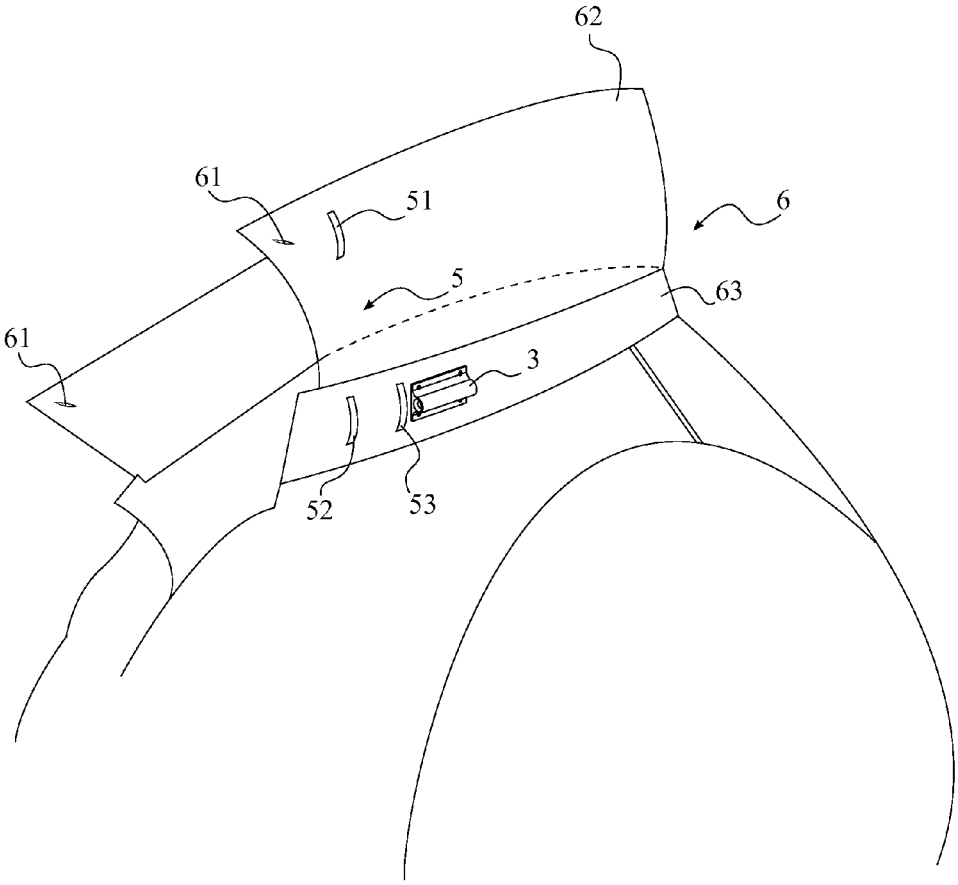
FIG. 28 is a perspective view of the locking encasement and a plurality of loops of the present invention being attached to the shirt collar.
Figure 29:
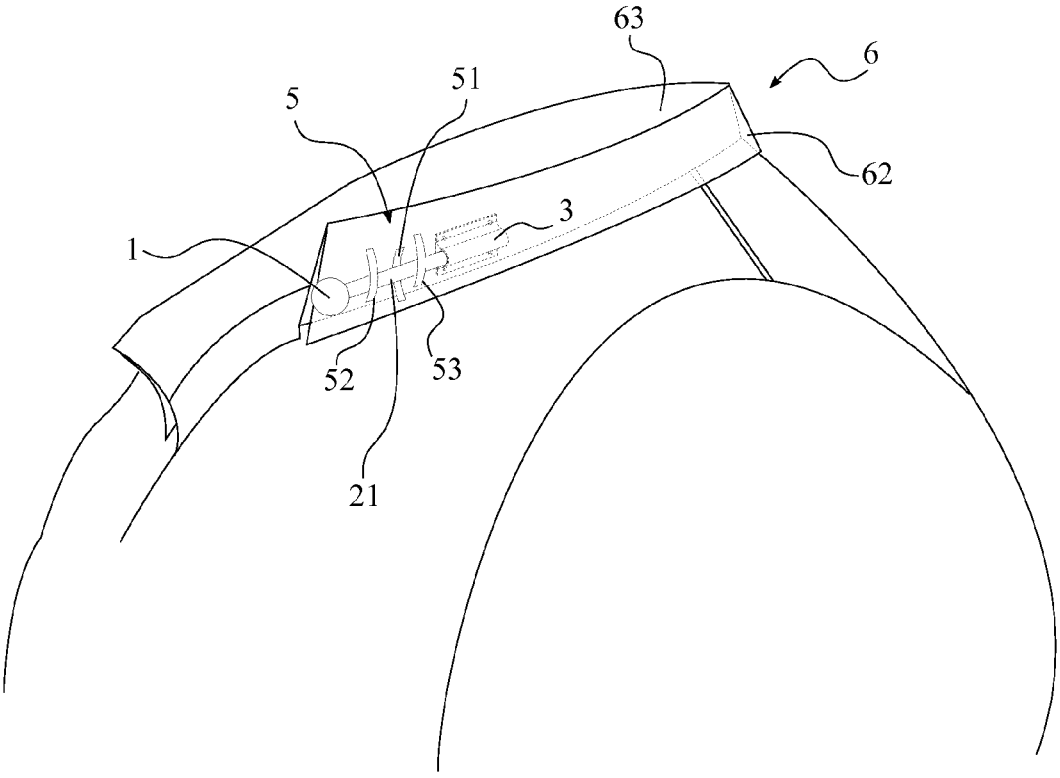
FIG. 29 is a perspective view of the present invention being attached to the shirt collar, wherein the broken lines illustrate hidden components.

In reference to FIG. 25, in order for the present invention to display with the shirt collar 6, the attachment bar 2 is inserted through a collar hole 61, where the collar hole 61 is positioned on an upper collar section 62 of the shirt collar 6, and the attachment bar 2 is engaged with the locking encasement 3. When the attachment bar 2 inserted through the collar hole 61, the ornamental head 1 is positioned outside the collar hole 61, and the central shaft 21 is inserted through the plurality of loops 5 that comprises a top collar loop 51, a first bottom collar loop 52, and a second bottom collar loop 53. In reference to FIG. 28, the top collar loop 51 is positioned in between the first bottom collar loop 52 and the second bottom collar loop 53, where the top collar loop 51 is connected with the upper collar section 62 and the first bottom collar loop 52 and the second bottom collar loop 53 are connected with the bottom collar section 63 by stitching or any other desired method of connections. Since the perimeter of the ornamental head 1 is bigger than the perimeter of the attachment bar 2 and the collar hole 61, the ornamental head 1 does not go through the collar hole 61, but covers the collar hole 61 while providing the decorative appearance. In reference to FIG. 29, when the attachment bar 2 is inserted through the plurality of loops 5, the central shaft 21 is respectively traversed through the first bottom collar loop 52, the top collar loop 51, and the second bottom collar loop 53. Since the upper collar section 62 is folded over the bottom collar section 63, the plurality of loops 5 provides a smooth and clean surface for the upper collar section 62, eliminating rumpled, creased, flimsy, and popped properties from the shirt collar 6. The plurality of loops 5 also eliminates space between the shirt and the shirt collar 6 and presents a crisp appearance. In reference to FIG. 10 and FIG. 11, once the attachment bar 2 is engaged with the locking encasement 3, the central shaft 21 is adjacently positioned with the front surface 31, and the tail portion 22 is concentrically positioned within the elastic locking casing 38. The tail portion 22 securely attaches with the elastic locking casing 38 since the elastic locking casing 38 elastically expands due to the perimeter pressure of the tail portion 22. In reference to FIG. 26, since the shirt collar 6 has two collar holes 61, two locking encasements 3 are adjacently connected with each of the collar holes 61 so that two attachment bars 2 can be inserted through the two collar holes 61, providing the decorative appearance for each of the collar holes 61 with the ornamental head 1. In reference to FIG. 24 and FIG. 27, the shirt collar 6 may have four ornamental heads 1, where additional two collar holes 61 are created so that the third and fourth ornamental head 1 can be attached to the shirt collar 6.

Figure 26:
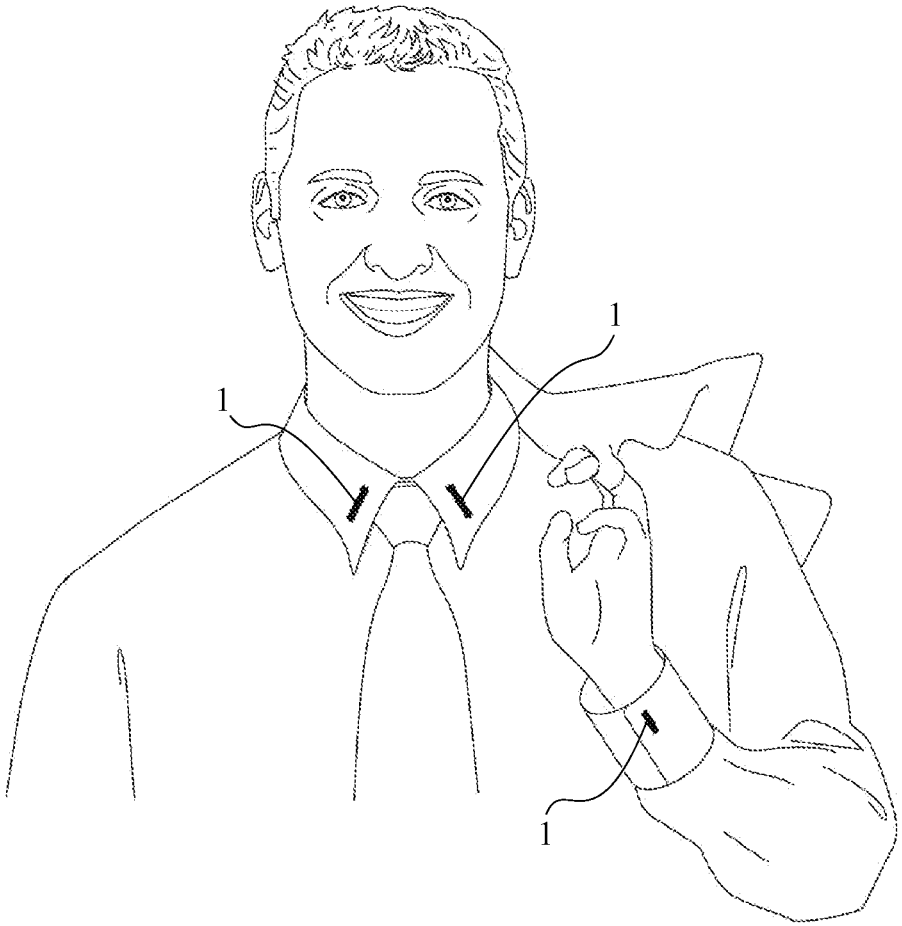
FIG. 26 is a third alternative front-side illustration of the present invention in use on the shirt collar and a sleeve cuff of the wearer.

In reference to FIG. 26, in order for the present invention to display with the sleeve cuffs, the attachment bar 2 is inserted through a front end sleeve hole and a back end sleeve hole of each of the sleeve cuffs, where the front end sleeve hole is positioned on a front extremity of each of the sleeve cuff, and the back end sleeve hole is positioned on a back extremity of each of the sleeve cuff. When the attachment bar 2 inserted through the front end sleeve hole and the back end sleeve hole, the ornamental head 1 is positioned outside the front end sleeve hole. Since the perimeter of the ornamental head 1 is bigger than the perimeter of the attachment bar 2 and the front end sleeve hole, the ornamental head 1 does not go through the front end sleeve hole, but covers the front end sleeve hole while providing the decorative appearance. The central shaft 21 is positioned within the front end sleeve hole and the back end sleeve hole, where the central shaft 21 may be bent in order to accommodate the curvature of sleeve cuffs so providing a smooth attachment in between the front end sleeve hole and the back end sleeve hole. The locking encasement 3 is adjacently connected with the back end sleeve hole. Once the attachment bar 2 is engaged with the locking encasement 3, the central shaft 21 is adjacently positioned with the front surface 31, and the tail portion 22 is concentrically positioned within the elastic locking casing 38. The tail portion 22 securely attaches with the elastic locking casing 38 since the elastic locking casing 38 elastically expands due to the perimeter pressure of the tail portion 22. In reference to FIG. 27, the sleeve cuffs may have two ornamental heads 1, where additional holes are created within the sleeve cuffs so that the second ornamental head 1 can be attached to the sleeve cuffs.

Figure 12:
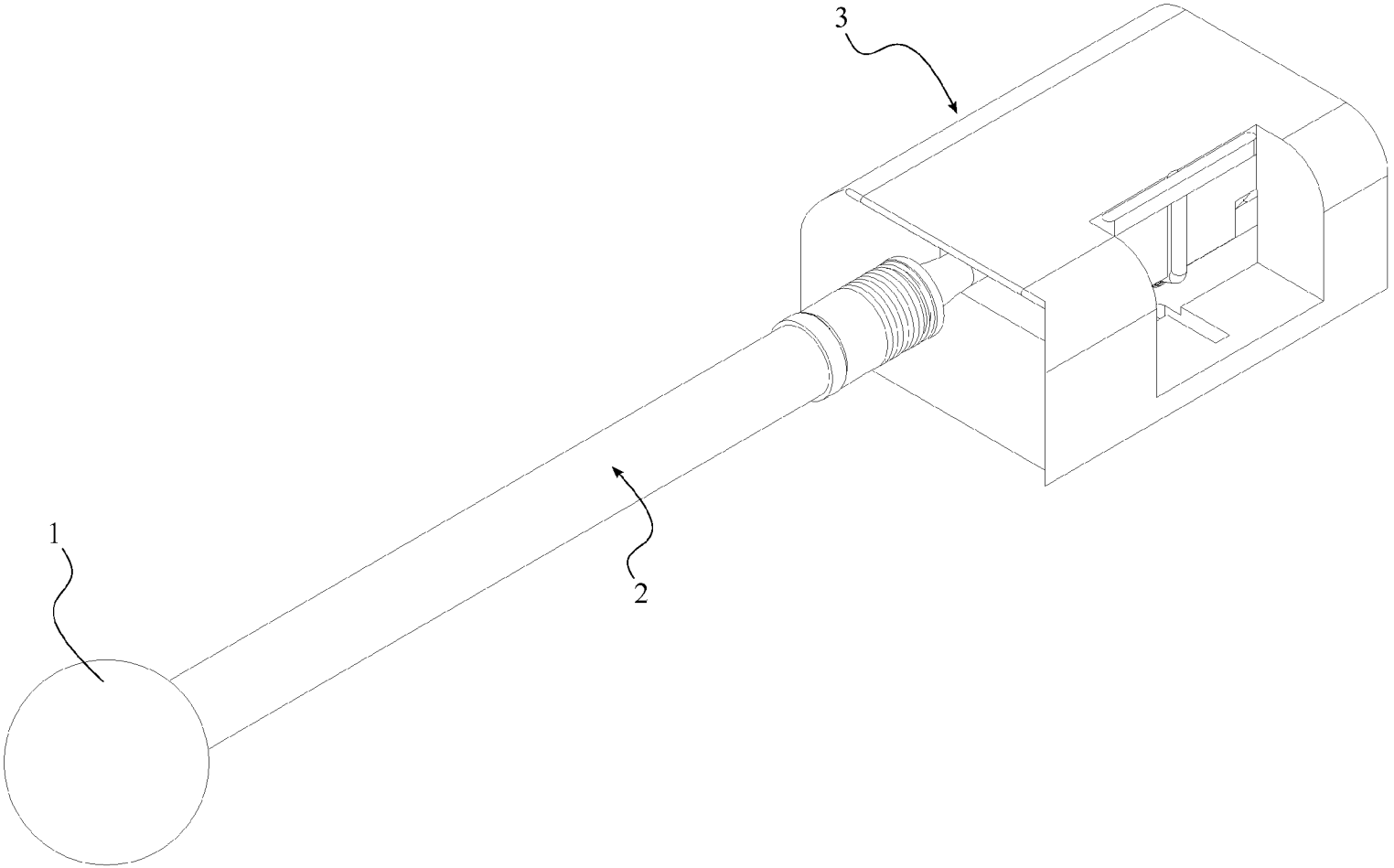
FIG. 12 is a perspective view of a first alternative embodiment of the present invention.
Figure 14:
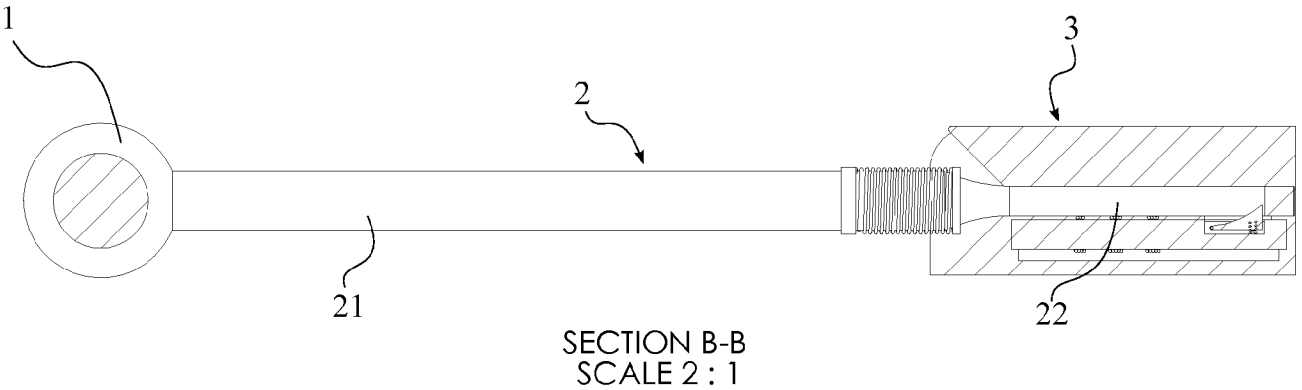
FIG. 14 is a cross section view of the first alternative embodiment of the present invention taken along line B-B of FIG. 13.
Figure 13:
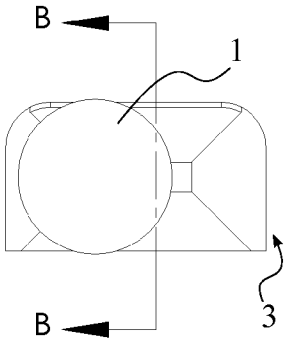
FIG. 13 is a front view of the first alternative embodiment of the present invention, showing the plane upon which a cross sectional view is taken shown in FIG. 14.

In reference to FIG. 12, a first alternative embodiment of the present invention comprises the ornamental head 1, the attachment bar 2, and the locking encasement 3. Similar to the preferred embodiment, the ornamental head 1 is connected to the central shaft 21 of the attachment bar 2, and the tail portion 22 of attachment bar 2 engaged with the encasement cavity 37 by the locking mechanism. In reference to FIG. 13 and FIG. 14, the locking mechanism of the first alternative embodiment, the tail portion 22 comprises a tension spring, a spring stop, a rectangular protrusion, and the encasement cavity 37 comprises a hollow section, an opening, and a mechanical lever lock. The mechanical lever lock comprises a handle, pegged springs, a rotatable rod, a rod channel, a rod fin, a rod hinge, and a rod locking spring. The tension spring and the spring stop are concentrically positioned around the tail portion 22, where the tension spring is permanently connected to the central shaft 21 and the spring stop, but the spring stop is able to slide alone the tail portion 22. The rectangular protrusion is connected to the tail portion 22 opposite from the central shaft 21. The hollow section is positioned below the encasement cavity 37 and positioned in between the bottom surface 33 and encasement cavity 37. The opening is traversed from the encasement cavity 37 to the hollow section. The rod cavity is positioned on the rotatable rod, and the pegged springs, the rotatable rod, the rod fin, the rod hinge, and the rod locking spring are positioned within the hollow section, where the handle extends out from the second side edge 35 through a side opening. The rod fin is positioned within the rod cavity, and the rod fin is pivotally connected to the rod cavity through the rod hinge and protruded out from the rod cavity due to the rod locking spring, that is positioned in between the rod fin and rod cavity and connected to the rod cavity. Due to the rod locking spring, the rod fin protrudes through the opening and into the encasement cavity 37. The rotatable rod is pivotally connected within the hollow section, and the pegged springs, which are connected to the rotatable rod, keep the rotatable rod in a locked position as the rod fin extends through the opening. The rotatable rod is permanently connected with the handle, where any downward movement of the handle simultaneously rotates the rotatable rod. When the tail portion 22 is inserted into the encasement cavity 37, the rectangular protrusion slides over a top angled surface of the rod fin as the rod fin gets push back into the rod channel. Once the rectangular protrusion passes through the top angled surface, the rod fin bounced back into the locked position, and the rectangular protrusion is positioned behind a vertical surface of the rod fin which locks the tail portion 22. At the same time, the spring stop adjacently positions with the front surface 31, compressing the tension spring against the front surface 31. When the attachment bar 2 needs to be unlocked, the handle is pushed down by the user, where the rotation of the rotatable rod turns the rod fin into the hollow section through the opening. Then the tail portion 22 is pushed out from the encasement cavity 37 by the compressed spring force of the tension spring. Once the tail portion 22 passes the rod fin, the handle can be released, allowing the rotatable rod to moves back into the locked position.

Figure 15:
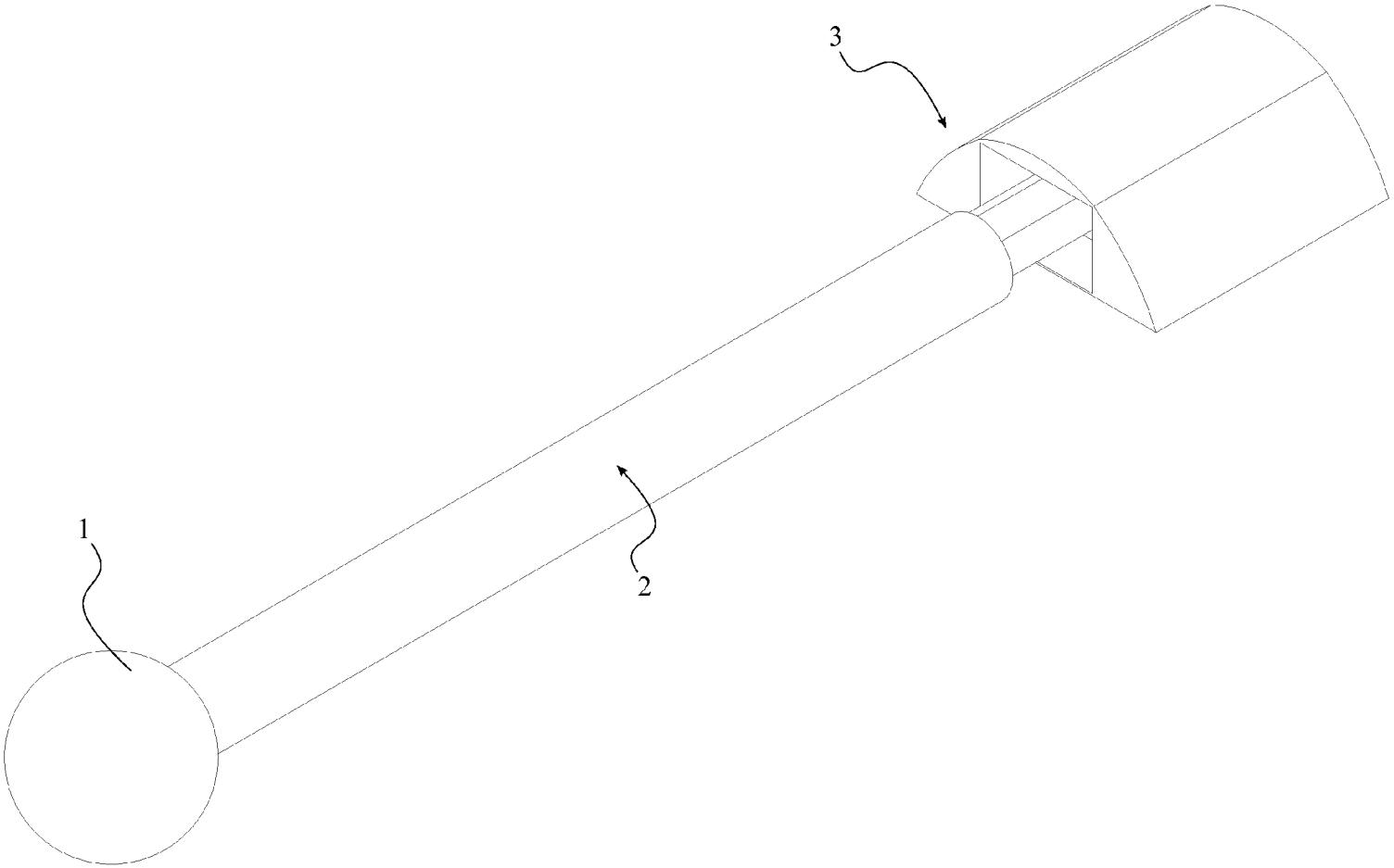
FIG. 15 is a perspective view of a second alternative embodiment of the present invention.
Figure 17:
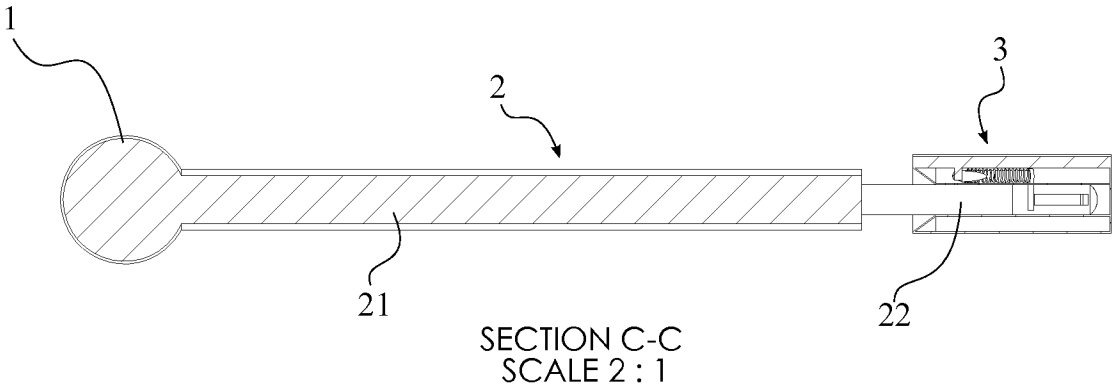
FIG. 17 is a cross section view of the second alternative embodiment of the present invention taken along line C-C of FIG. 16.
Figure 16:
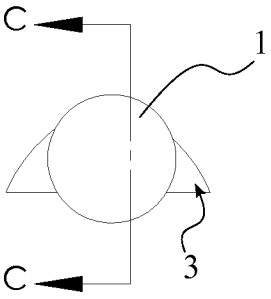
FIG. 16 is a front view of the second alternative embodiment of the present invention, showing the plane upon which a cross sectional view is taken shown in FIG. 17.

In reference to FIG. 15, a second alternative embodiment of the present invention comprises the ornamental head 1, the attachment bar 2, and the locking encasement 3. Similar to the preferred embodiment, the ornamental head 1 is connected to the central shaft 21 of the attachment bar 2, and the tail portion 22 of attachment bar 2 engaged with the encasement cavity 37 by the locking mechanism. In reference to FIG. 16 and FIG. 17, the locking mechanism of the second alternative embodiment, the tail portion 22 comprises a thicker portion and a thinner portion, and the encasement cavity 37 comprises an angled channel, an angled cylindrical bar, a push lock spring, a locking latch that comprises a locking portion and a slidable portion. The thinner portion comprises a tail channel, a tail fin, a tail hinge, and a tail locking spring. The thicker portion is connected to the central shaft 21 opposite from the ornamental head 1, and the thinner portion is connected to the thicker portion opposite from the central shaft 21. The tail cavity is positioned on the thinner portion. The tail fin is positioned within the tail cavity, and the tail fin is pivotally connected to the tail cavity through the tail hinge and protruded out from the tail cavity due to the tail locking spring, that is positioned in between the tail fin and tail cavity and connected to the tail cavity. The angled channel is poisoned in between the encasement cavity 37 and the geometric top surface 36 and opens into the encasement cavity 37. The angled cylindrical bar is positioned within the angled channel and the locking latch is positioned around the angled cylindrical bar through the slidable portion. The locking portion is adjacently positioned with the inner base 371 and protrudes into the encasement cavity 37 though the angled channel since the slidable portion and the locking portion is connected to each other. The push lock spring, which is a tension spring at its natural states, is concentrically and movably positioned around the angled cylindrical bar and permanently connected to the locking latch and the angular cylindrical bar. When the tail portion 22 is inserted into the encasement cavity 37, the locking portion slides along a side angled surface of the tail fin as the tail fin gets push back into the tail channel. Once the locking portion passes through the top angled surface, the tail fin bounced back into the initial position, and locking portion is positioned behind a vertical surface of the tail fin which locks the tail portion 22 within the vertical surface of the tail fin and the thicker portion. In order to unlock the attachment bar 2 from the locking encasement 3, the attachment bar 2 is pulled out from the encasement cavity 37. When the attachment bar 2 is pulled out, the slidable portion compress the push lock spring as the locking portion makes contact with the vertical surface of the tail fin. Due to the positioning of the angled channel within the encasement cavity 37, the locking portion moves along the angled channel until the locking portion slips over the vertical surface separating the tail portion 22 from the encasement cavity 37. Then the users can separate the attachment bar 2 from the locking encasement 3, and the push lock spring and the locking latch move back into the initial position.

Figure 18:
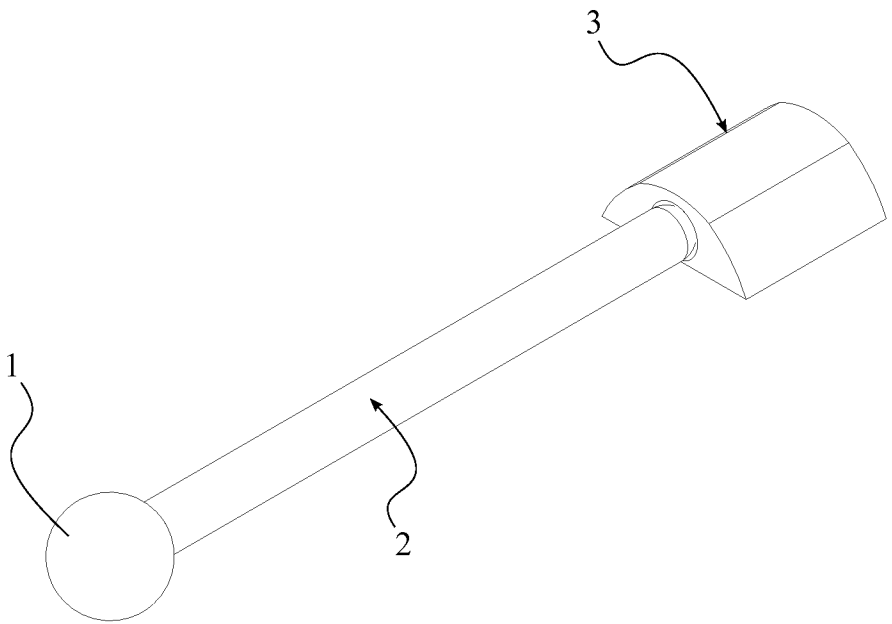
FIG. 18 is a perspective view of a third alternative embodiment of the present invention.
Figure 20:
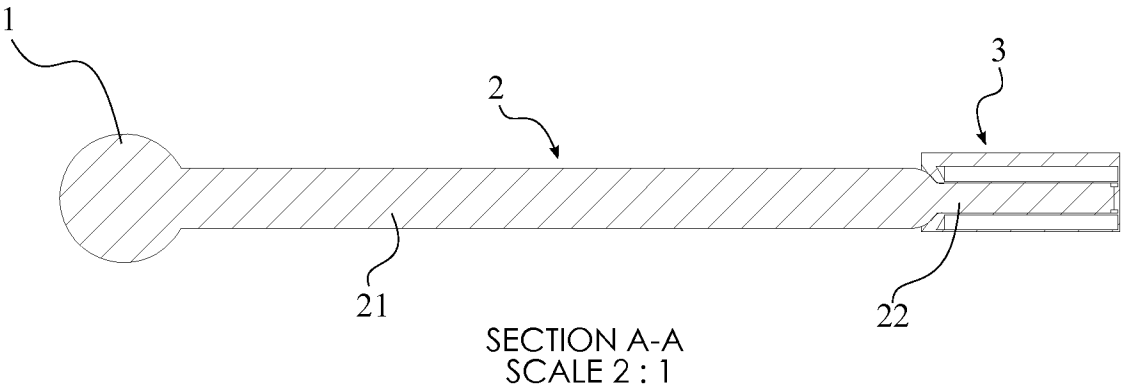
FIG. 20 is a cross section view of the third alternative embodiment of the present invention taken along line A-A of FIG. 19.
Figure 19:
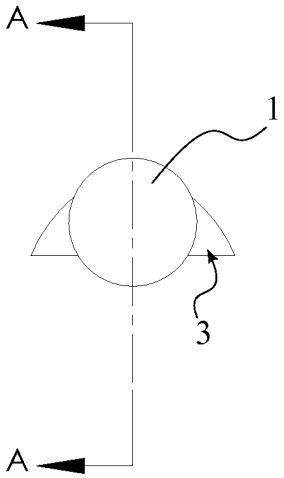
FIG. 19 is a front view of the third alternative embodiment of the present invention, showing the plane upon which a cross sectional view is taken shown in FIG. 20.

In reference to FIG. 18, a third alternative embodiment of the present invention comprises the ornamental head 1, the attachment bar 2, and the locking encasement 3. Similar to the preferred embodiment, the ornamental head 1 is connected to the central shaft 21 of the attachment bar 2, and the tail portion 22 of attachment bar 2 engaged with the encasement cavity 37 by the locking mechanism. With reference to the locking mechanism of the third alternative embodiment, the tail portion 22 comprises a first magnet, and the encasement cavity 37 comprises a second magnet that is oppositely attracted to the first magnet. The first magnet is connected to the tail portion 22 opposite from the central shaft 21. The second magnet is connected to the inner base 371 of the encasement cavity 37, although the second magnet may be placed anywhere within the encasement. When the attachment bar 2 is inserted into the locking encasement 3, the first magnet is magnetically attracted to the second magnet, keeping the attachment bar 2 in place. The user may remove the attachment bar 2 by pulling the attachment bar 2 out of the locking encasement 3 which overcomes the magnetic force of attraction of the first magnet and the second magnet.

Figure 21:
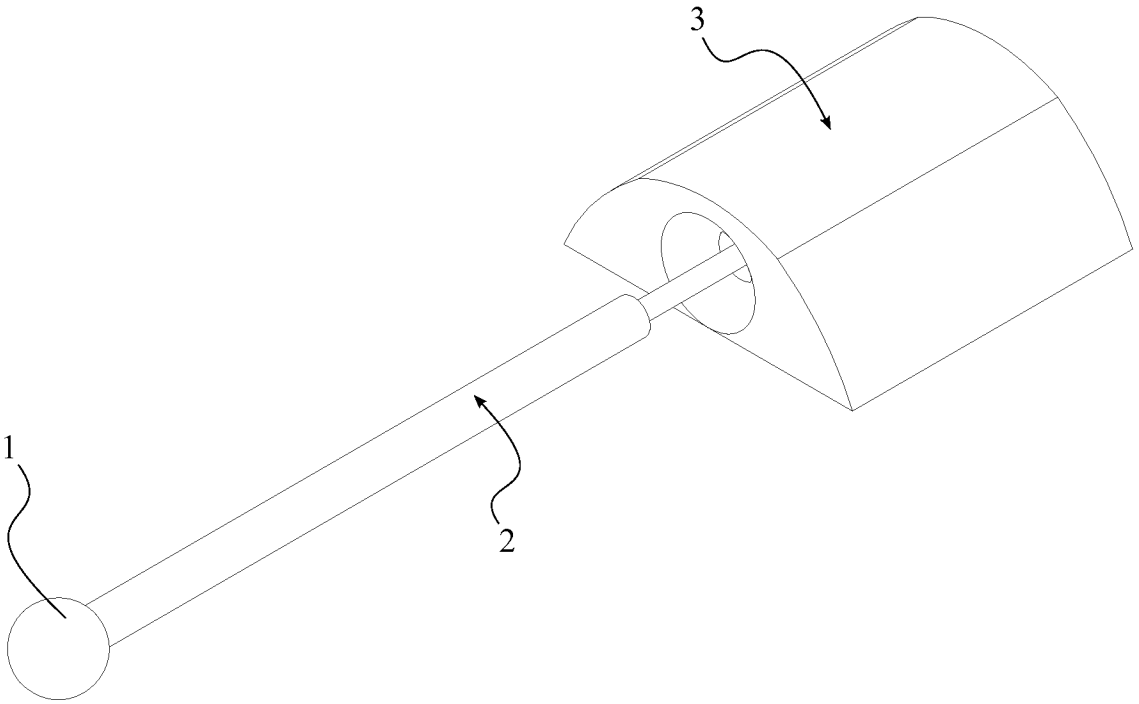
FIG. 21 is a perspective view of a fourth alternative embodiment of the present invention.
Figure 23:
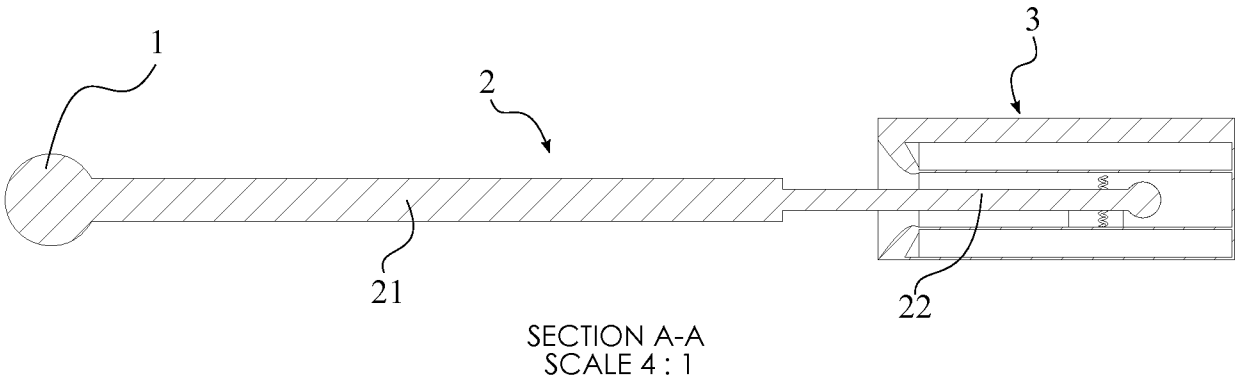
FIG. 23 is a cross section view of the fourth alternative embodiment of the present invention taken along line A-A of FIG. 22.
Figure 22:
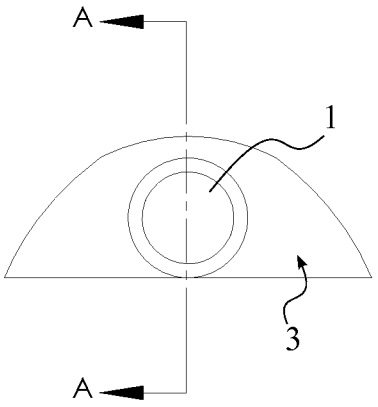
FIG. 22 is a front view of the fourth alternative embodiment of the present invention, showing the plane upon which a cross sectional view is taken shown in FIG. 23.

In reference to FIG. 21, a fourth alternative embodiment of the present invention comprises the ornamental head 1, the attachment bar 2, and the locking encasement 3. Similar to the preferred embodiment, the ornamental head 1 is connected to the central shaft 21 of the attachment bar 2, and the tail portion 22 of attachment bar 2 engaged with the encasement cavity 37 by the locking mechanism. In reference to FIG. 22 and FIG. 23, the locking mechanism of the fourth alternative embodiment, the tail portion 22 comprises a spherical end, and the encasement cavity 37 comprises at least two lock springs. The spherical end is concentrically positioned with the tail portion 22 opposite from the central shaft 21. The at least two lock spring are positioned within the encasement cavity 37 and positioned parallel to one another. The attachment bar 2 is inserted between the at least two lock springs, where the spherical end pushes the at least two lock springs out of the way. Once the spherical end passes the at least two lock springs, the at least two lock springs move back into initial position around the tail portion 22. This locks the attachment bar 2 within the encasement cavity 37. The user can pull the attachment bar 2 out of the locking encasement 3, overcoming the tension of the at least two lock springs to pull the spherical end through the at least two lock springs. The tension on the at least two lock springs help to eject the attachment bar 2 from the encasement cavity 37. The space between the at least two lock springs can be adjusted smaller or bigger based on the size of the spherical end and the desired tension. Likewise, the at least two lock springs can be compressed or spread depending on the desired tension.

In the preferred embodiment, the attachment bar 2 is preferably 1/16 of an inch in diameter. The ornamental head 1 is preferably 5/32 of an inch in diameter and the collar hole 61 in the shirt collar 6 is preferably larger than 1/16 of an inch but smaller than 5/32 of an inch, allowing the attachment bar 2 to be inserted but not allowing the ornamental head 1 to pass through. The total length of the attachment bar 2 is preferably 1.5 inches. Each of the plurality of loops 5 is preferably 2/16 of an inch tall. Although these dimensions apply for the preferred embodiments, any desired dimensions may be used for the preferred embodiment and the alternative embodiments of the present invention.

Although the invention has been explained in relation to its preferred embodiment, it is to be understood that many other possible modifications and variations can be made without departing from the spirit and scope of the invention as hereinafter claimed.

What is claimed is:

1. A decorative attaching apparatus for the shirt collar and the sleeve cuffs comprises:

an ornamental head;

an attachment bar;

a locking encasement;

a plurality of loops;

the attachment bar comprises a central shaft and a tail portion;

the locking encasement comprises a front surface, a rear surface, a bottom surface, a first side edge, a second side edge, a geometric top surface, an encasement cavity, an elastic locking casing, and a plurality of attachments;

the plurality of loops comprises a top collar loop, a first bottom collar loop, and a second bottom collar loop, wherein the plurality of loops is connected with a shirt collar;

the ornamental head being concentrically connected with the attachment bar, wherein a perimeter of the ornamental head is bigger than a perimeter of the attachment bar; and the attachment bar being attached with the locking encasement opposite from the ornamental head.

2. The decorative attaching apparatus for the shirt collar and the sleeve cuffs as claimed in claim 1 comprises:

the ornamental head being concentrically connected with the central shaft;

the central shaft being concentrically positioned with the tail portion; and the central shaft being positioned in between the ornamental head and the tail portion.

3. The decorative attaching apparatus for the shirt collar and the sleeve cuffs as claimed in claim 1 comprises:

the front surface and the rear surface being oppositely positioned from each other;

the bottom surface being perpendicularly positioned with the front surface and the rear surface;

the first side edge being perpendicularly positioned with the front surface, rear surface, and the bottom surface;

the second side edge being oppositely positioned from the first side edge;

the second side edge being perpendicularly positioned with the front surface, rear surface, and the bottom surface;

the geometric top surface being perimetrically positioned with the front surface, the rear surface, the first side edge, and the second side edge;

the encasement cavity being traversed through the front surface;

the encasement cavity being positioned within the bottom surface, the rear surface, the first side edge, the second side edge, and the geometric top surface;

the elastic locking casing being concentrically positioned within the encasement cavity; and the plurality of attachments being adjacently positioned with the first side edge and the second side edge.

4. The decorative attaching apparatus for the shirt collar and the sleeve cuffs as claimed in claim 3 comprises:

the encasement cavity comprises an inner base and an inner lateral wall;

the elastic locking casing comprises an outer base and an outer lateral wall;

the inner base being permanently connected with the outer base by an adhesive material; and the inner lateral wall being permanently connected with the outer lateral wall by the adhesive material.

5. The decorative attaching apparatus for the shirt collar and the sleeve cuffs as claimed in claim 1 comprises:

the top collar loop being connected to an upper collar section of the shirt collar;

the first bottom collar loop being connected to a bottom collar section of the shirt collar, wherein the upper collar section and the bottom collar section are connected to each other;

the second bottom collar loop being connected to the bottom collar section; and the top collar loop being positioned in between the first bottom collar loop and the second bottom collar loop.

6. The decorative attaching apparatus for the shirt collar and the sleeve cuffs as claimed in claim 1 comprises:

the ornamental head being adjacently positioned with a collar hole of the shirt collar;

the central shaft being respectively traversed through the first bottom collar loop, the top collar loop, and the second bottom collar loop;

the central shaft being adjacently positioned with the front surface; and the tail portion being concentrically positioned within the elastic locking casing, wherein the elastic locking casing secures the attachment bar within the locking encasement as the elastic locking casing deforms due to the insertion of the tail portion.

7. A decorative attaching apparatus for the shirt collar and the sleeve cuffs comprises:

an ornamental head;

an attachment bar;

a locking encasement;

a plurality of loops;

the attachment bar comprises a central shaft and a tail portion;

the locking encasement comprises a front surface, a rear surface, a bottom surface, a first side edge, a second side edge, a geometric top surface, an encasement cavity, an elastic locking casing, and a plurality of attachments;

the plurality of loops comprises a top collar loop, a first bottom collar loop, and a second bottom collar loop, wherein the plurality of loops is connected with a shirt collar;

the ornamental head being concentrically connected with the attachment bar, wherein a perimeter of the ornamental head is bigger than a perimeter of the attachment bar;

the ornamental head being concentrically connected with the central shaft;

the central shaft being concentrically positioned with the tail portion;

the central shaft being positioned in between the ornamental head and the tail portion; and the attachment bar being attached with the locking encasement opposite from the ornamental head.

8. The decorative attaching apparatus for the shirt collar and the sleeve cuffs as claimed in claim 7 comprises:

the front surface and the rear surface being oppositely positioned from each other;

the bottom surface being perpendicularly positioned with the front surface and the rear surface;

the first side edge being perpendicularly positioned with the front surface, rear surface, and the bottom surface;

the second side edge being oppositely positioned from the first side edge;

the second side edge being perpendicularly positioned with the front surface, rear surface, and the bottom surface;

the geometric top surface being perimetrically positioned with the front surface, the rear surface, the first side edge, and the second side edge;

the encasement cavity being traversed through the front surface;

the encasement cavity being positioned within the bottom surface, the rear surface, the first side edge, the second side edge, and the geometric top surface;

the elastic locking casing being concentrically positioned within the encasement cavity; and the plurality of attachments being adjacently positioned with the first side edge and the second side edge.

9. The decorative attaching apparatus for the shirt collar and the sleeve cuffs as claimed in claim 8 comprises:

the encasement cavity comprises an inner base and an inner lateral wall;

the elastic locking casing comprises an outer base and an outer lateral wall;

the inner base being permanently connected with the outer base by an adhesive material; and the inner lateral wall being permanently connected with the outer lateral wall by the adhesive material.

10. The decorative attaching apparatus for the shirt collar and the sleeve cuffs as claimed in claim 7 comprises:

the top collar loop being connected to an upper collar section of the shirt collar;

the first bottom collar loop being connected to a bottom collar section of the shirt collar, wherein the upper collar section and the bottom collar section are connected to each other;

the second bottom collar loop being connected to the bottom collar section; and the top collar loop being positioned in between the first bottom collar loop and the second bottom collar loop.

11. The decorative attaching apparatus for the shirt collar and the sleeve cuffs as claimed in claim 7 comprises:

the ornamental head being adjacently positioned with a collar hole of the shirt collar;

the central shaft being respectively traversed through the first bottom collar loop, the top collar loop, and the second bottom collar loop;

the central shaft being adjacently positioned with the front surface; and the tail portion being concentrically positioned within the elastic locking casing, wherein the elastic locking casing secures the attachment bar within the locking encasement as the elastic locking casing deforms due to the insertion of the tail portion.

12. A decorative attaching apparatus for the shirt collar and the sleeve cuffs comprises:

an ornamental head;

an attachment bar;

a locking encasement;

a plurality of loops;

the attachment bar comprises a central shaft and a tail portion;

the locking encasement comprises a front surface, a rear surface, a bottom surface, a first side edge, a second side edge, a geometric top surface, an encasement cavity, an elastic locking casing, and a plurality of attachments;

the plurality of loops comprises a top collar loop, a first bottom collar loop, and a second bottom collar loop, wherein the plurality of loops is connected with a shirt collar;

the ornamental head being concentrically connected with the attachment bar, wherein a perimeter of the ornamental head is bigger than a perimeter of the attachment bar;

the ornamental head being concentrically connected with the central shaft;

the central shaft being concentrically positioned with the tail portion;

the central shaft being positioned in between the ornamental head and the tail portion; and the attachment bar being attached with the locking encasement opposite from the ornamental head.

13. The decorative attaching apparatus for the shirt collar and the sleeve cuffs as claimed in claim 12 comprises:

the front surface and the rear surface being oppositely positioned from each other;

the bottom surface being perpendicularly positioned with the front surface and the rear surface;

the first side edge being perpendicularly positioned with the front surface, rear surface, and the bottom surface;

the second side edge being oppositely positioned from the first side edge;

the second side edge being perpendicularly positioned with the front surface, rear surface, and the bottom surface;

the geometric top surface being perimetrically positioned with the front surface, the rear surface, the first side edge, and the second side edge;

the encasement cavity being traversed through the front surface;

the encasement cavity being positioned within the bottom surface, the rear surface, the first side edge, the second side edge, and the geometric top surface;

the elastic locking casing being concentrically positioned within the encasement cavity;

the plurality of attachments being adjacently positioned with the first side edge and the second side edge;

the encasement cavity comprises an inner base and an inner lateral wall;

the elastic locking casing comprises an outer base and an outer lateral wall;

the inner base being permanently connected with the outer base by an adhesive material; and the inner lateral wall being permanently connected with the outer lateral wall by the adhesive material.

14. The decorative attaching apparatus for the shirt collar and the sleeve cuffs as claimed in claim 12 comprises:

the top collar loop being connected to an upper collar section of the shirt collar;

the first bottom collar loop being connected to a bottom collar section of the shirt collar, wherein the upper collar section and the bottom collar section are connected to each other;

the second bottom collar loop being connected to the bottom collar section; and the top collar loop being positioned in between the first bottom collar loop and the second bottom collar loop.

15. The decorative attaching apparatus for the shirt collar and the sleeve cuffs as claimed in claim 12 comprises:

the ornamental head being adjacently positioned with a collar hole of the shirt collar;

the central shaft being respectively traversed through the first bottom collar loop, the top collar loop, and the second bottom collar loop;

the central shaft being adjacently positioned with the front surface; and the tail portion being concentrically positioned within the elastic locking casing, wherein the elastic locking casing secures the attachment bar within the locking encasement as the elastic locking casing deforms due to the insertion of the tail portion.

* * * * *